US011801589B1

(12) United States Patent
Huang

(10) Patent No.: US 11,801,589 B1
(45) Date of Patent: Oct. 31, 2023

(54) EXPANSION TOOL STRUCTURE FOR STEERING KNUCKLE OF VEHICLE

(71) Applicant: Chuan Mao Huang, Taichung (TW)

(72) Inventor: Chuan Mao Huang, Taichung (TW)

( * ) Notice: Subject to any disclaimer, the term of this patent is extended or adjusted under 35 U.S.C. 154(b) by 0 days.

(21) Appl. No.: 17/953,444

(22) Filed: Sep. 27, 2022

(30) Foreign Application Priority Data

Aug. 25, 2022 (TW) ..... 111209271

(51) Int. Cl.
*B25B 27/00* (2006.01)

(52) U.S. Cl.
CPC ..... *B25B 27/0035* (2013.01)

(58) Field of Classification Search
CPC . B25B 27/00; B25B 27/0021; B25B 27/0035; B25B 27/023; B25B 27/14; B25B 13/48; B23P 19/04; B23P 19/06; B23P 15/406; Y10T 29/53687
USPC ..... 81/484, 485; 29/238, 239, 240, 253, 255
See application file for complete search history.

(56) References Cited

U.S. PATENT DOCUMENTS 2,352,290 A * 6/1944 Saul ..... B25B 27/16 29/239
3,426,752 A * 2/1969 Laico ..... A61F 15/02 606/53
3,762,688 A * 10/1973 Leonhardt ..... A62B 3/005 254/133 R
3,997,957 A * 12/1976 Tone ..... F16L 23/003 29/256

* cited by examiner

*Primary Examiner* — Lee D Wilson
*Assistant Examiner* — Alberto Saenz

(57) ABSTRACT

An expansion tool structure for a steering knuckle of a vehicle contains: a body, a multiple-section positioning set, and a rotatable connector. The body includes a receiving orifice, a first rotation portion, a recess, a second rotation portion, a stopped face, two retainers, a holding protrusion, a notch, a hollow accommodation section, and a threaded orifice. The multiple-section positioning set includes a locating ball, a resilient element, and a threaded post. The rotatable connector includes a holder, four slots, a first rotatable coupling section, a second rotatable coupling section, a stepped edge, an extension, a C-shaped ring, and a non-circular joining portion. The rotatable connector further includes an actuation projection, and the actuation projection has two opposite elongated faces and two opposite short faces. Preferably, a width of a respective one short face is equal to or is less than a width of a respective one retainer.

3 Claims, 7 Drawing Sheets

EXPANSION TOOL STRUCTURE FOR STEERING KNUCKLE OF VEHICLE

FIELD OF THE INVENTION

The present invention relates to an expansion tool structure for a steering knuckle of a vehicle which is capable of obtaining easy assembly of the expansion tool structure and removing the knob mechanism quickly.

BACKGROUND OF THE INVENTION

A conventional removal tool of a steering knuckle of a vehicle contains at least two steering knuckles for expanding a car chassis to remove at least to knob mechanisms clamped by the at least two steering knuckles. The removal tool includes a support post, two slidable blocks, and two defining posts. The support post has at least two guide columns vertically connected thereon, and the at least two guide columns have two drive segments formed on at least two tops thereof and the at least two guide columns have at least two expanding segments configured to expand the at least two steering knuckles. The support post further has two peripheral sections formed on two sides thereof and passing through the two slidable blocks, and the two slidable blocks has a lower passing portion configured to pass through the guide columns, wherein a respective one guide post has a locating portion configured to position two sides of the at least two steering knuckles, hence the at least two guide posts are applied to support the steering knuckles stably.

However, the conventional removal tool is complicated to cause high fabrication cost. Furthermore, the at least two expanding segments are tilted to damage the two steering knuckles.

The present invention has arisen to mitigate and/or obviate the afore-described disadvantages.

SUMMARY OF THE INVENTION

One aspect of the present invention is to provide an expansion tool structure for a steering knuckle of a vehicle by which the non-circular joining portion of the rotatable connector guides the actuation projection to rotate and the two opposite short faces of the actuation projection rotatably force two inner walls of the removal zone and to move to the 90-degree position, such that the actuation projection expands the removal zone of the steering knuckle to avoid abrasion of the steering knuckle, thus obtaining easy assembly of the expansion tool structure and removing the knob mechanism quickly.

To obtain the above aspect, an expansion tool structure for a steering knuckle of a vehicle provided by the present invention contains: a body, a multiple-section positioning set, and a rotatable connector.

The body includes a receiving orifice defined on the body, a first rotation portion formed on a first end of the receiving orifice, a recess formed on a side of the rotation portion, a second rotation portion formed on a second end of the receiving orifice, a stopped face defined between the second rotation portion and the receiving orifice, two retainers extending from an end of the body and corresponding to the second rotation portion, a holding protrusion formed on a top of the body, a notch defined on a bottom of the holding protrusion, a hollow accommodation section formed in the holding protrusion above the notch, and a threaded orifice defined in a top of the holding protrusion. The notch is in communication with the receiving orifice.

The multiple-section positioning set includes a locating ball, a resilient element, and a threaded post formed from a top of the multiple-section positioning set to a bottom of the multiple-section positioning set. The locating ball is accommodated in the notch of the body, the resilient element is received in the hollow accommodation section of the body, the threaded post has a screwing section formed on an outer wall thereof, and the threaded post has a recess defined on a top thereof such that the screwing section of the threaded post is screwed with the threaded orifice of the body and abuts against a top of the resilient element.

a rotatable connector including a holder having an axial line and received in the receiving orifice of the body so that the axial line of the holder is coaxial with the receiving orifice of the body, and four slots defined on an outer wall of the holder and corresponding to the multiple-section positioning set so as to obtain four positioning positions. Preferably, an angle between any two adjacent slots is degrees. The rotatable connector further includes a first rotatable coupling section formed on a first end of the holder, a second rotatable coupling section formed on a second end of the holder. The first rotatable coupling section is arranged on the first rotation portion of the body, and the second rotatable coupling section is arranged on the second rotation portion of the body, a stepped edge is formed between the holder and the second rotatable coupling section and is configured to stop and limit the stopped face of the body; the rotatable connector further includes an extension extending on an end of the first rotatable coupling section, a C-shaped ring engaged with the recess of the body and configured to stop and limit the first rotatable coupling section, and a non-circular joining portion formed on an end of the extension and extending out of the body.

The rotatable connector further includes an actuation projection extending from an end of the second rotatable coupling section opposite to the second end of the holder, formed in a rectangle shape, and located between the two retainers of the body.

The actuation projection has two opposite elongated faces and two opposite short faces, and a width of a respective one short face is equal to or is less than a width of a respective one retainer.

DETAILED DESCRIPTION OF THE PREFERRED EMBODIMENTS

Figure 1:
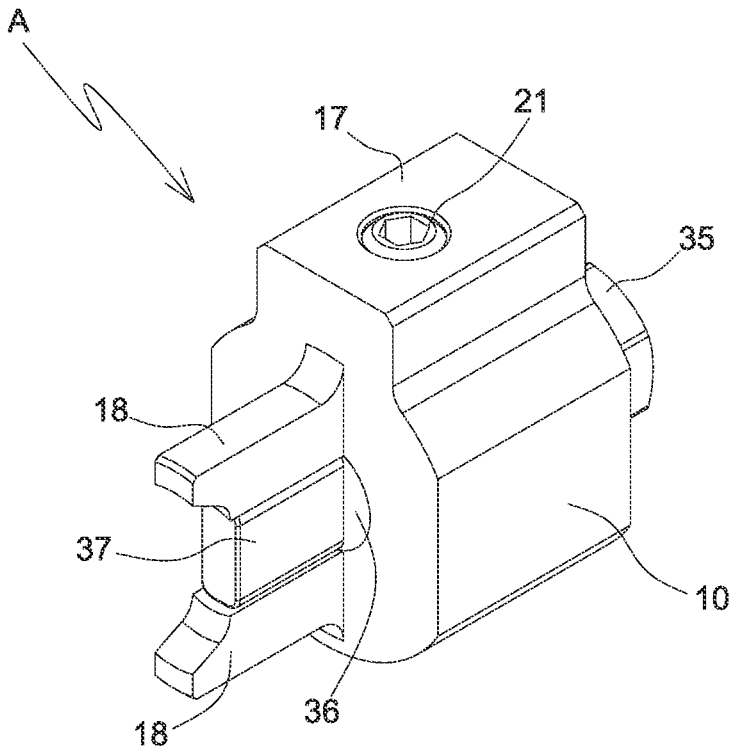
FIG. 1 is a perspective view showing the assembly of an expansion tool structure for a steering knuckle of a vehicle according to a preferred embodiment of the present invention.
Figure 2:
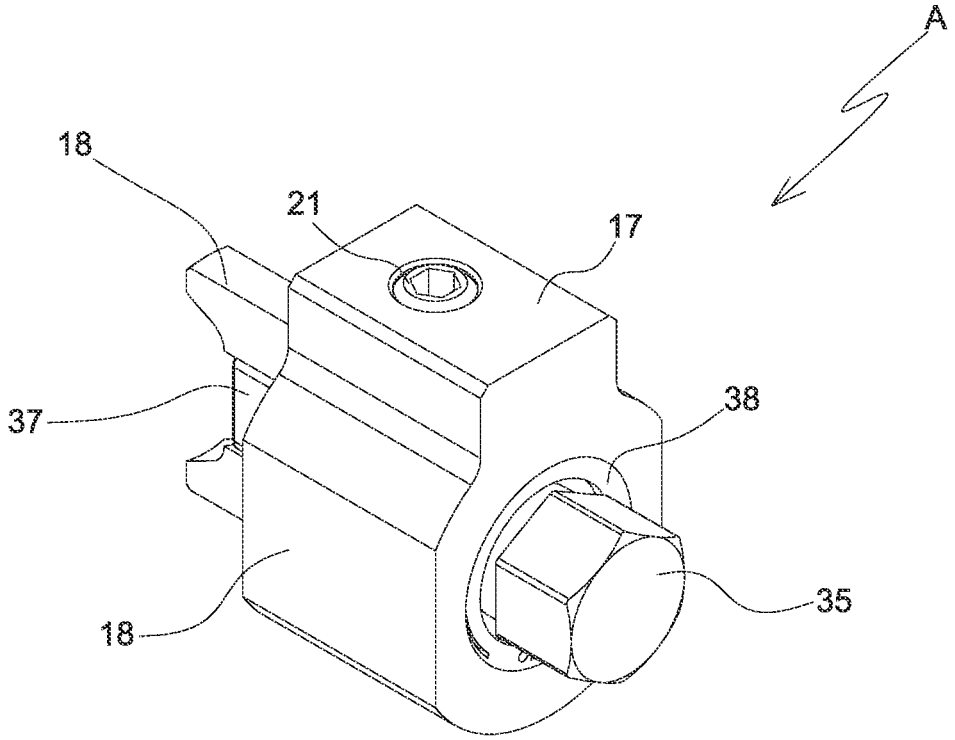
FIG. 2 is another perspective view showing the assembly of the expansion tool structure for the steering knuckle of the vehicle according to the preferred embodiment of the present invention.
Figure 3:
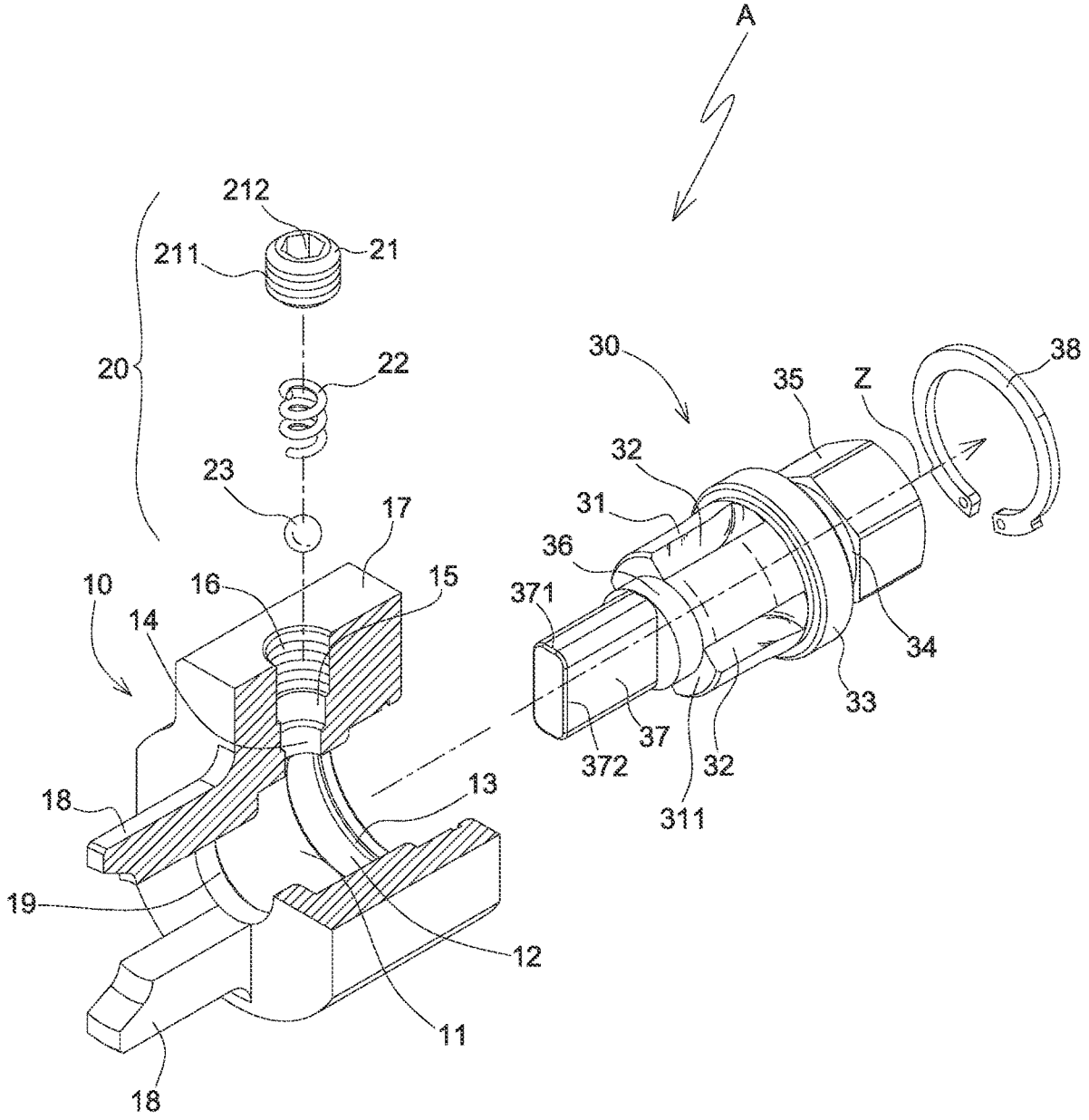
FIG. 3 is a cross-sectional perspective view showing the exploded of the expansion tool structure for the steering knuckle of the vehicle according to the preferred embodiment of the present invention.
Figure 4:
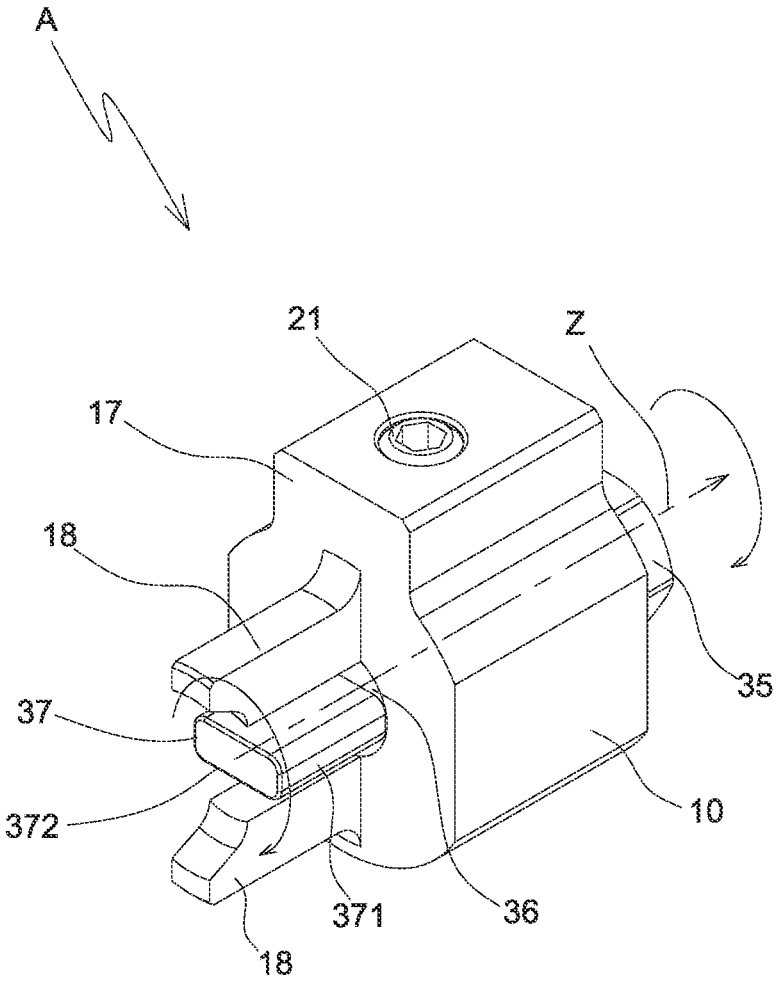
FIG. 4 is a perspective view showing the operation of the expansion tool structure for the steering knuckle of the vehicle according to the preferred embodiment of the present invention.
Figure 5:
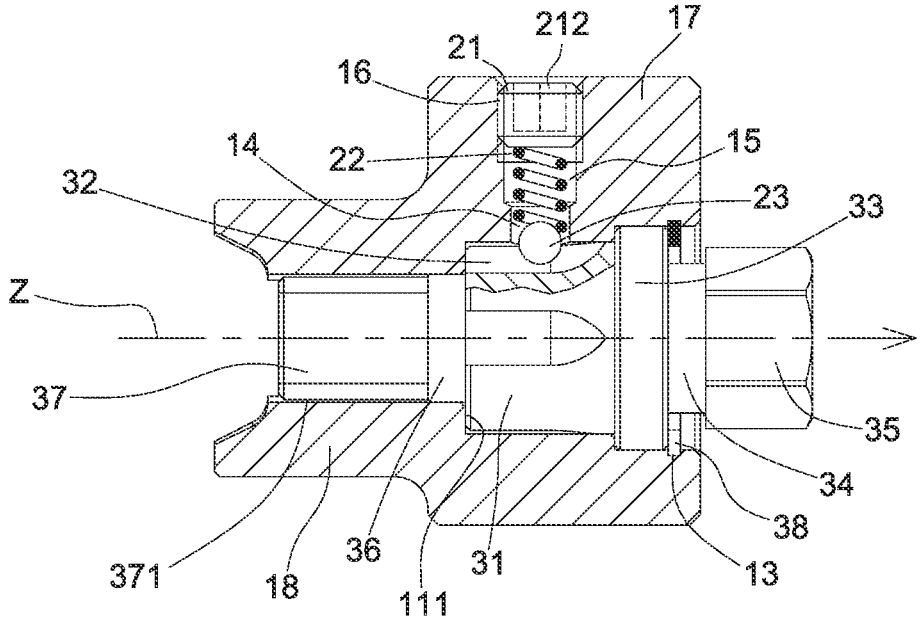
FIG. 5 is a cross sectional view showing the assembly of the expansion tool structure for the steering knuckle of the vehicle according to the preferred embodiment of the present invention.
Figure 6:
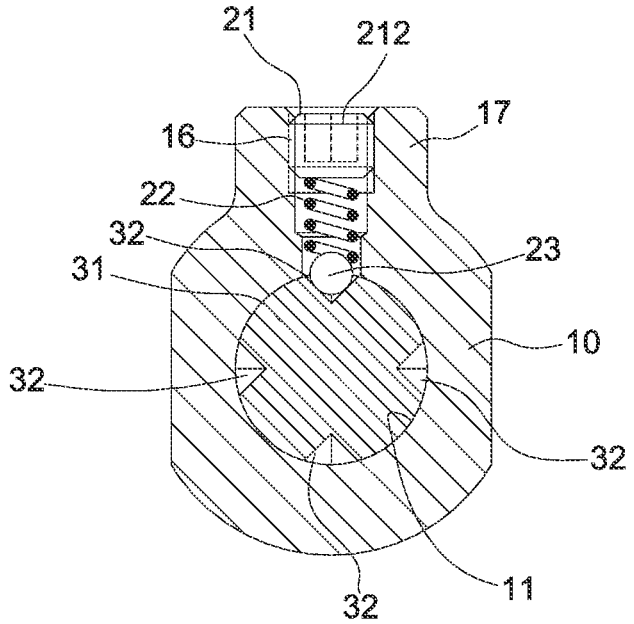
FIG. 6 is another cross sectional view showing the assembly of the expansion tool structure for the steering knuckle of the vehicle according to the preferred embodiment of the present invention.
Figure 7:
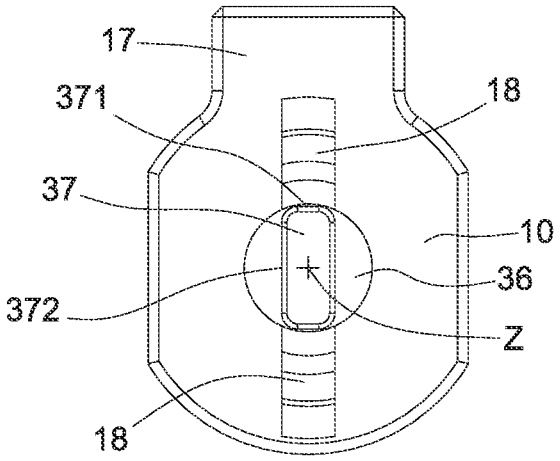
FIG. 7 is a side plan view showing the assembly of the expansion tool structure for the steering knuckle of the vehicle according to the preferred embodiment of the present invention.
Figure 8:
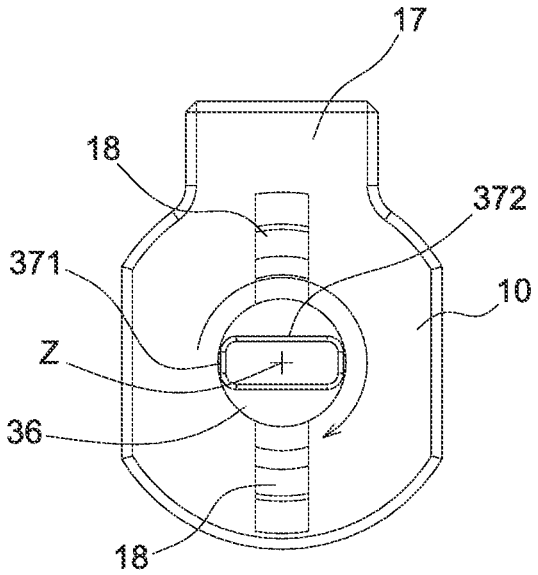
FIG. 8 is a side plan view showing the operation of the expansion tool structure for the steering knuckle of the vehicle according to the preferred embodiment of the present invention.

With reference to FIGS. 1 to 10, an expansion tool structure for a steering knuckle of a vehicle according to a first embodiment of the present invention comprises:

a body 10 including a receiving orifice 11 defined thereon, a first rotation portion 12 formed on a first end of the receiving orifice 11, a recess 13 formed on a side of the rotation portion 12, a second rotation portion 10 formed on a second end of the receiving orifice 11, a stopped face 11*l* defined between the second rotation portion 10 and the receiving orifice 11, two retainers 18 extending from an end of the body 10 and corresponding to the second rotation portion 19, a holding protrusion 17 formed on a top of the body 10, a notch 14 defined on a bottom of the holding protrusion 17, a hollow accommodation section 15 formed in the holding protrusion 17 above the notch 14, and a threaded orifice 16 defined in a top of the holding protrusion 17, wherein the notch 14 is in communication with the receiving orifice 11;

a multiple-section positioning set 20 including a locating ball 23, a resilient element, and a threaded post 21 formed from a top of the multiple-section positioning set 20 to a bottom of the multiple-section positioning set 20, wherein the locating ball 23 is accommodated in the notch 14 of the body 10, the resilient element 22 is received in the hollow accommodation section 15 of the body 10, the threaded post 21 has a screwing section 211 formed on an outer wall thereof, and the threaded post 21 has a recess 212 defined on a top thereof, such that the screwing section 211 of the threaded post 21 is screwed with the threaded orifice 16 of the body 10 and abuts against a top of the resilient element 22; and a rotatable connector 30 including a holder 31 having an axial line Z and received in the receiving orifice 11 of the body 10 so that the axial line Z of the holder 31 is coaxial with the receiving orifice 11 of the body 10, and four slots 32 defined on an outer wall of the holder 31 and corresponding to the multiple-section positioning set 20 so as to obtain four positioning positions, wherein an angle between any two adjacent slots 32 is 90 degrees; the rotatable connector 30 further includes a first rotatable coupling section 33 formed on a first end of the holder 31, a second rotatable coupling section 36 formed on a second end of the holder 31, wherein the first rotatable coupling section 33 is arranged on the first rotation portion 12 of the body 10, and the second rotatable coupling section 36 is arranged on the second rotation portion 19 of the body 10, wherein a diameter of the first rotatable coupling section 33 is more than a diameter of the holder 31, a diameter of the holder 31 is more than a diameter of the second rotatable coupling section 36 so that a stepped edge 311 is formed between the holder 31 and the second rotatable coupling section 36 and is configured to stop and limit the stopped face 111 of the body 10; the rotatable connector 30 further includes an extension 34 extending on an end of the first rotatable coupling section 33, a C-shaped ring 38 engaged with the recess 13 of the body 10 and configured to stop and limit the first rotatable coupling section 33, and a non-circular joining portion 35 formed on an end of the extension 34, wherein the non-circular joining portion 35 is formed in a hexagon shape, the non-circular joining portion 35 extends out of the body 10 and is rotated by a hand tool; the rotatable connector 30 further includes an actuation projection 37 extending from an end of the second rotatable coupling section 36 opposite to the second end of the holder 31, formed in a rectangle shape, and located between the two retainers 18 of the body 10, wherein the actuation projection 37 has two opposite elongated faces 372 and two opposite short faces 371, wherein a width of a respective one short face 371 is equal to or is less than a width of a respective one retainer 18, and the respective one short face 371 is a plane.

Figure 9:
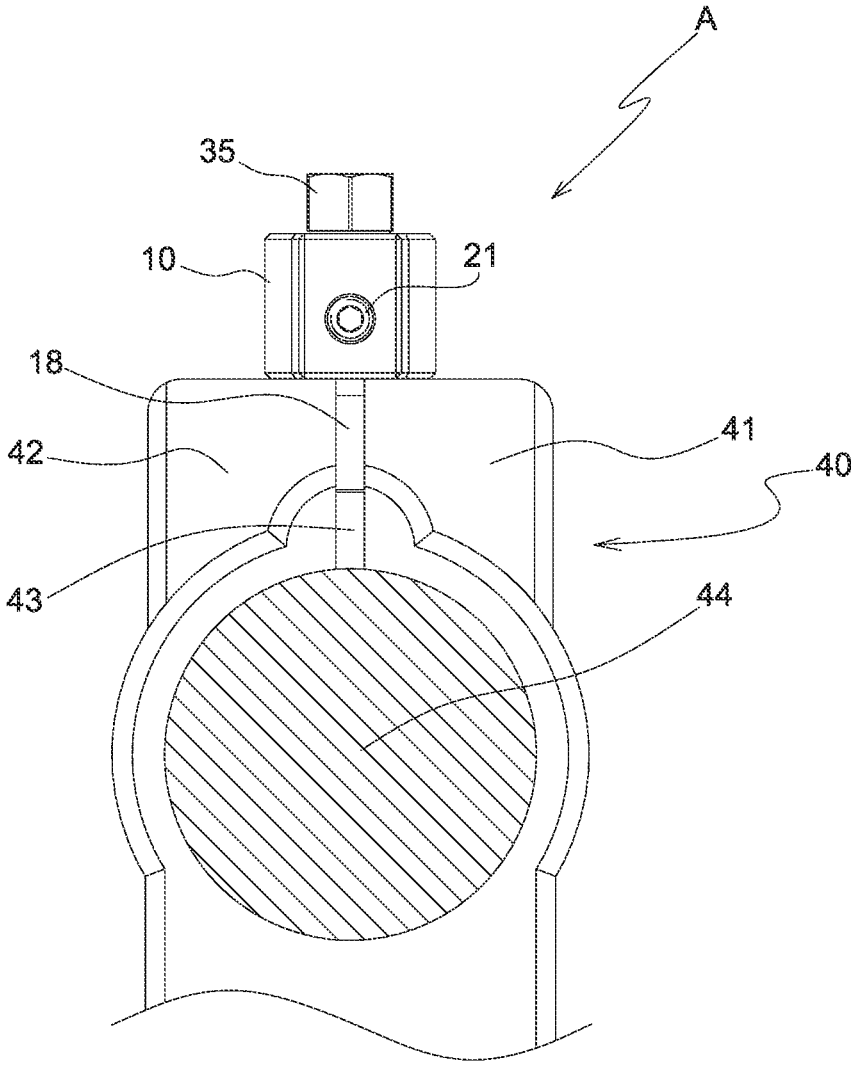
FIG. 9 is a cross sectional view showing the operation of the expansion tool structure for the steering knuckle of the vehicle according to the preferred embodiment of the present invention.
Figure 10:
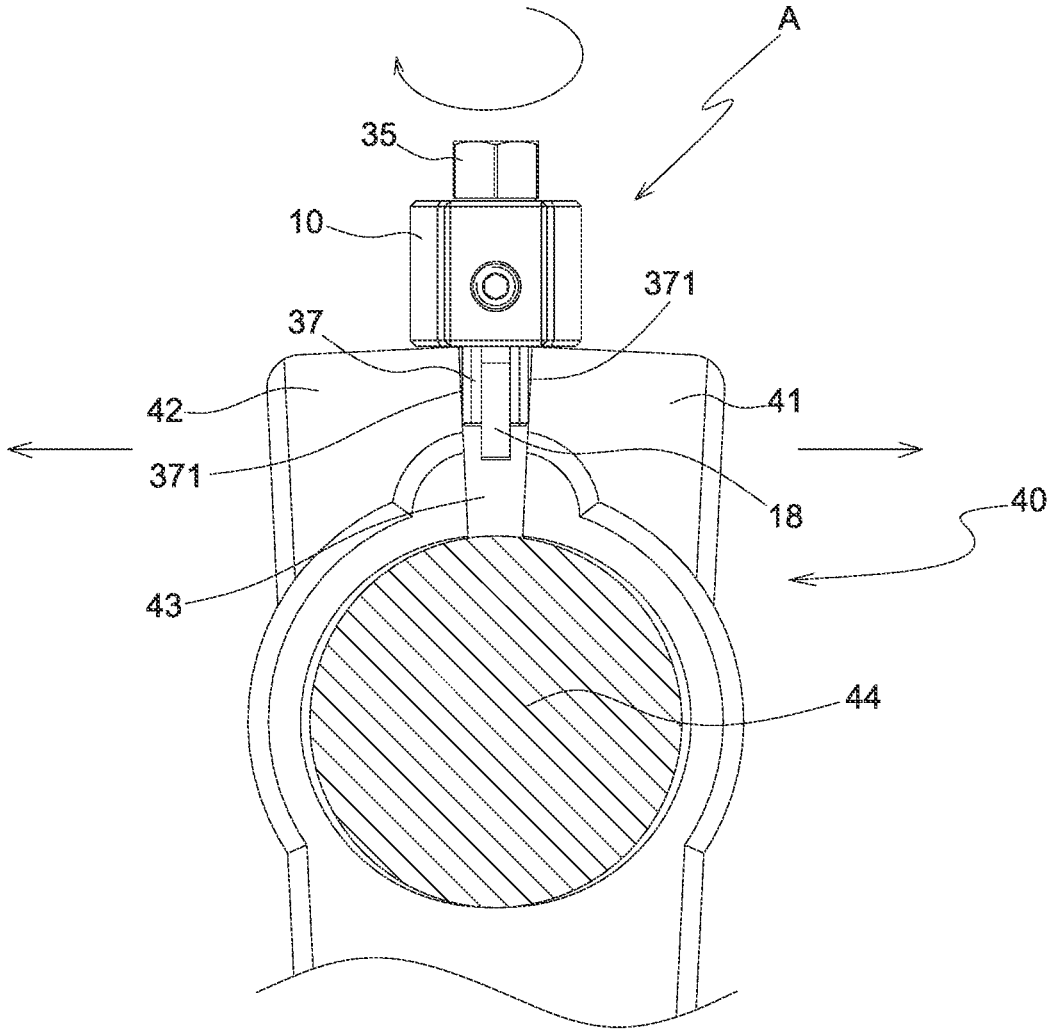
FIG. 10 is another cross sectional view showing the operation of the expansion tool structure for the steering knuckle of the vehicle according to the preferred embodiment of the present invention.

Referring to FIG. 9-10, in operation, the two retainers 18 mate with the actuation projection 37 to expand the steering knuckle 40, because a length of a respective one elongated face 372 of the actuation projection 37 is more than the width of the respective one retainer 18.

The two opposite short faces 371 of the actuation projection 37 are aligned with the two retainers 18, wherein the width of the respective one short face 371 is equal to or is less than the width of the respective one retainer 18, thus the actuation projection 37 flush with the two retainers 18 so that the respective one retainer 18 and the actuation projection 37 are engaged in an removal zone 43 between a first knuckle portion 41 and a second knuckle portion 42 of the steering knuckle 40, then the non-circular joining portion 35 of the rotatable connector 30 is rotated 90 degrees by using the hand tool so that the locating ball 23 of the multiple-section positioning set 20 is pushed by the resilient element 22 to abut against another slot 32 and the actuation projection 37 is guided to rotate 90 degrees, wherein when the actuation projection 37 is guided to rotate, the two opposite short faces 371 of the actuation projection 37 rotatably force two inner walls of the removal zone 43 and move to a 90-degree position. Thereafter, the actuation projection 37 expands the removal zone 43 of the steering knuckle 40, and the two opposite short faces 371 contacts with the two inner walls of the removal zone 43 of the steering knuckle 40, thus removing a knob mechanism 44 for repairing or replacement.

Accordingly, the non-circular joining portion 35 of the rotatable connector 30 guides the actuation projection 37 to rotate and the two opposite short faces 371 of the actuation projection 37 rotatably force two inner walls of the removal zone 43 and to move to the 90-degree position, such that the actuation projection 37 expands the removal zone 43 of the steering knuckle 40 to avoid abrasion of the steering knuckle 40, thus obtaining easy assembly of the expansion tool structure A and removing the knob mechanism 44 quickly.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. An expansion tool structure for a steering knuckle of a vehicle comprising:

a body including a receiving orifice defined on the body, a first rotation portion formed on a first end of the receiving orifice, a recess formed on a side of the rotation portion, a second rotation portion formed on a second end of the receiving orifice, a stopped face defined between the second rotation portion and the receiving orifice, two retainers extending from an end of the body and corresponding to the second rotation portion, a holding protrusion formed on a top of the body, a notch defined on a bottom of the holding protrusion, a hollow accommodation section formed in the holding protrusion above the notch, and a threaded orifice defined in a top of the holding protrusion, wherein the notch is in communication with the receiving orifice;

a multiple-section positioning set including a locating ball, a resilient element, and a threaded post formed from a top of the multiple-section positioning set to a bottom of the multiple-section positioning set, wherein the locating ball is accommodated in the notch of the body, the resilient element is received in the hollow accommodation section of the body, the threaded post has a screwing section formed on an outer wall thereof, and the threaded post has a recess defined on a top thereof, such that the screwing section of the threaded post is screwed with the threaded orifice of the body and abuts against atop of the resilient element; and a rotatable connector including a holder having an axial line and received in the receiving orifice of the body so that the axial line of the holder is coaxial with the receiving orifice of the body, and four slots defined on an outer wall of the holder and corresponding to the multiple-section positioning set so as to obtain four positioning positions, wherein an angle between any two adjacent slots is 90 degrees; the rotatable connector further includes a first rotatable coupling section formed on a first end of the holder, a second rotatable coupling section formed on a second end of the holder, wherein the first rotatable coupling section is arranged on the first rotation portion of the body, and the second rotatable coupling section is arranged on the second rotation portion of the body, wherein a stepped edge is formed between the holder and the second rotatable coupling section and is configured to stop and limit the stopped face of the body; the rotatable connector further includes an extension extending on an end of the first rotatable coupling section, a C-shaped ring engaged with the recess of the body and configured to stop and limit the first rotatable coupling section, and a non-circular joining portion formed on an end of the extension and extending out of the body;

wherein the rotatable connector further includes an actuation projection extending from an end of the second rotatable coupling section opposite to the second end of the holder, formed in a rectangle shape, and located between the two retainers of the body, wherein the actuation projection has two opposite elongated faces and two opposite short faces, wherein a width of a respective one short face is equal to or is less than a width of a respective one retainer.

2. The expansion tool structure as claimed in claim 1, wherein the respective one short face is a plane.

3. The expansion tool structure as claimed in claim 1, wherein a diameter of the first rotatable coupling section is more than a diameter of the bolder, and a diameter of the holder is more than a diameter of the second rotatable coupling section.

* * * * *